US006022076A

United States Patent [19]

Samson

[11] Patent Number: 6,022,076

[45] Date of Patent: Feb. 8, 2000

[54] RECLINABLE SEATING

[76] Inventor: Ilan Samson, 8A Chesterford Gardens, London, United Kingdom, NW 7DE

[21] Appl. No.: 09/171,306

[22] PCT Filed: Apr. 18, 1997

[86] PCT No.: PCT/US97/06557

§ 371 Date: Oct. 14, 1998

§ 102(e) Date: Oct. 14, 1998

[87] PCT Pub. No.: WO97/38608

PCT Pub. Date: Oct. 23, 1997

[30] Foreign Application Priority Data

Apr. 18, 1996 [GB] United Kingdom ..... 9608012

[51] Int. Cl.[7] ..... A47C 1/02; A47C 3/02

[52] U.S. Cl. ..... 297/281; 297/317; 297/328; 297/282

[58] Field of Search ..... 297/281, 282, 297/326, 327, 328, 316, 317, 325

[56] References Cited

U.S. PATENT DOCUMENTS

| | | | |
|---|---|---|---|
| 3,235,304 | 2/1966 | Glass | 297/327 |
| 3,711,152 | 1/1973 | Sirpak et al. | 297/326 |
| 4,790,599 | 12/1988 | Goldman | 297/327 |
| 5,108,148 | 4/1992 | Henke | 297/317 |

*Primary Examiner*—Anthony D. Barfield
*Attorney, Agent, or Firm*—George L. Greenfield; James W. Huffman

[57] ABSTRACT

A reclining chair having a base frame (1) supporting a reclining unit (2) by a mechanism having downwardly converging swing links (15 and 16) pivoted at their upper ends at (22 and 23) respectively to the frame, a rigid member (14) pivotally connected to the lower ends of the swing links (15 and 16 at 20 and 21). The rigid member (14) has a link (13) rigidly connected to it which in turn is rigidly connected to the reclining unit (2). The center of gravity of the reclining unit with its occupant is maintained in a substantially horizontal plane as the unit moves from upright to reclined positions.

4 Claims, 7 Drawing Sheets

RECLINABLE SEATING

INTRODUCTION

The present invention relates a suspension device for use in reclinable seating, particularly seating in which the reclinable unit comprises a back rest and seat portion formed in fixed relation to one another e.g. as an integral unit. This reclinable unit may also comprise a leg support or footrest portion.

In a reclining armchair as described in U.S. Pat. No. 4,790,599 there is a unitary seating element comprising a back rest, a seat and a footrest. This seating element is suspended from a base structure by a single pivot at each side, somewhat above the middle of the seating element, but lower than the arm rest level. FIGS. 2 and 3 of the '599 patent show such an arrangement in the upright and fully reclined states, respectively. FIGS. 1 and 2 of the present application schematically correspond to those drawings in the patent.

The problem with such an arrangement is the tendency of the chair, at least when occupied to fall into either the upright or the fully reclined position because the combined center of gravity, 5*a* and 5*b*, of the occupant and seating element is lower in these positions than in the intermediate position, 5*c*, as shown in FIG. 3 herein. Effort is needed to move out of these upright and fully reclined positions and elderly and handicapped people may not be able to emerge from the fully reclined position. The need to raise the centre of gravity when passing from the fully reclined to the intermediate position can be likened to a potential energy barrier which must be overcome in order for the occupant of the chair to rise from the fully reclined position. Thus, although the armchair described in U.S. Pat. No. 4,790,599 allows the user to adopt a comfortable and beneficial position in which the individual's feet are raised above the level of his heart, its suspension may be somewhat difficult to operate especially by elderly and handicapped persons.

The present invention provides a recliner chair comprising a linkage mechanism by which a reclinable unit is suspended from a base unit, the linkage mechanism comprising at least three members pivotally connected in series, two outer members of the series being pivotally secured to the base unit, the reclining unit being affixed, preferably rigidly, to an intermediate member of the series, rotation of the intermediate member between the two outer members of the series allowing movement of the reclinable unit between an upright and a fully reclined position about a pivotal axis. The pivotal axis preferably moves during movement of the reclinable unit between upright and fully reclined positions, this movement including a vertical component such that the combined center of gravity of the reclinable unit and any occupant remains at a substantially constant height.

The reclinable unit is connected to the base unit by at least one, and preferably two linkage mechanisms one on each side of the unit.

In a second aspect, the present invention provides a suspension device for a reclinable seating comprising a linkage mechanism by which a reclinable unit is suspended from a base unit, the linkage mechanism comprising at least three members pivotally connected in series, two outer members of the series being pivotally securable to the base unit, an intermediate member of the series being securable, preferably rigidly, to the reclinable unit, the intermediate member being rotatable between the two outer members of the series, about a pivotal axis, to permit movement of the reclinable unit between an upright and a fully reclined position.

Desirably, the linkage mechanism comprises three members pivotally connected in series. Preferably, the intermediate member of the series is formed in a T-shape, two arms of the T being pivotally linked to other members of the series the third arm of the T being rigidly securable to the reclinable unit. In one preferred embodiment, the relative lengths and proportions of the members of the linkage mechanism are substantially as shown in the accompanying FIGS. 4–8.

Thus, according to the present invention there is also provided a reclinable seating unit in which the axis of rotation of the reclinable element is lowered relative to a base unit as the reclinable element moves from a fully reclined to an intermediate position or from an upright to an intermediate position, and the axis is raised as the reclinable unit moves from an intermediate position to an upright position.

This combined vertical (raising and lowering) and rotational movement of the axis of rotation and also of the reclinable unit itself is permitted by the right attachment of the reclinable element to an intermediate member of a pivoting linkage mechanism, rotation of the intermediate member between two outer members of the mechanism leading to rotation of the reclinable element about moving axis, the movement of that axis having both horizontal and vertical components. In certain embodiments the intermediate position may be the most stable position of the reclinable element, at least when the seating is unoccupied, however in other embodiments no one position of the reclinable element is significantly more or less stable than another.

In preferred embodiments, the energy required for rotation of the reclinable element between the upright and an intermediate or between the fully reclined and the intermediate position is substantially equal to the energy gained by the lowering of the rotational axis of the reclinable unit, i.e. the torque of rotation multiplied by the increment of the rotational angle is substantially equal to the combined weight of the reclinable unit and the occupant multiplied by the distance through which the reclinable element is lowered during rotation through said angle increment from the upright to the intermediate or from the fully reclined to the intermediate position.

The invention will now be further described, by way of example only and not of limitation, with reference to the accompanying drawings in which:

FIG. 1 diagrammatically shows an occupied well-known prior art reclining armchair in the fully upright position;

FIG. 2 shows the prior art armchair of FIG. 1 in a fully reclined position;

FIG. 3 diagrammatically shows the movement of the combined centre of gravity of the reclining element and occupant during movement of the known armchair between the positions of FIG. 2 and FIG. 1;

Figure 4:
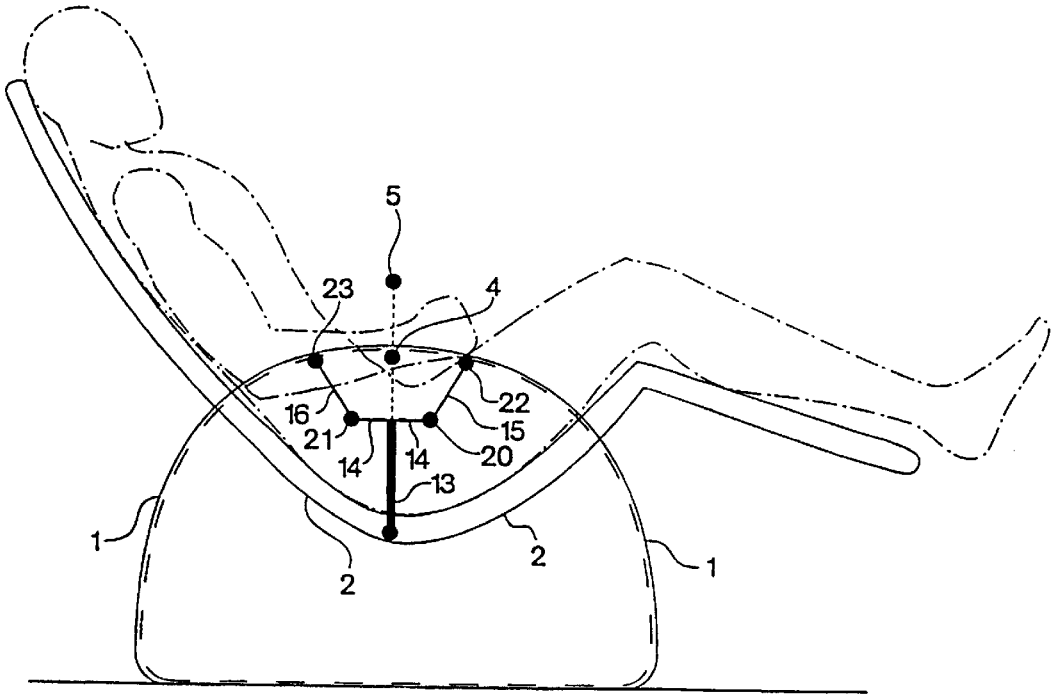
FIG. 4 shows a side view of an armchair incorporating a linkage mechanism according to the present invention.
Figure 9:
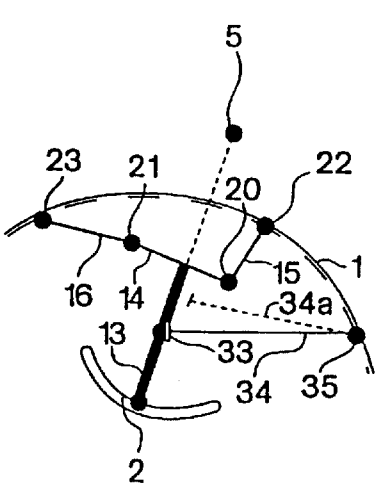
Figure 8:
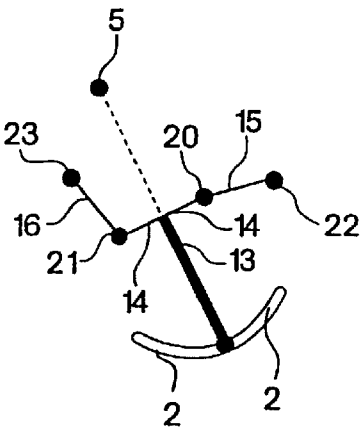
Figure 7:
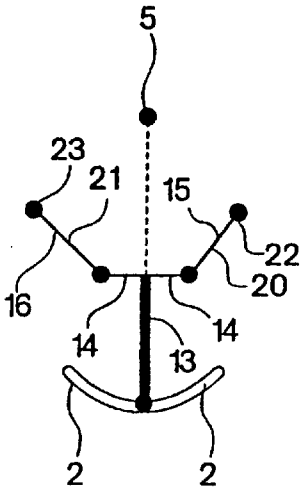
Figure 6:
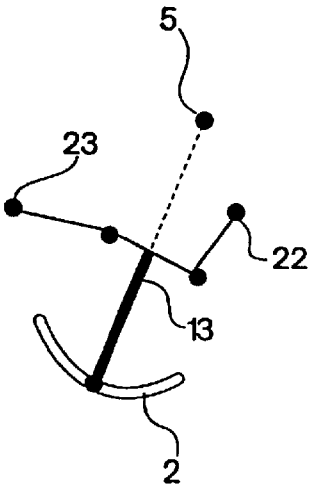
Figure 10:
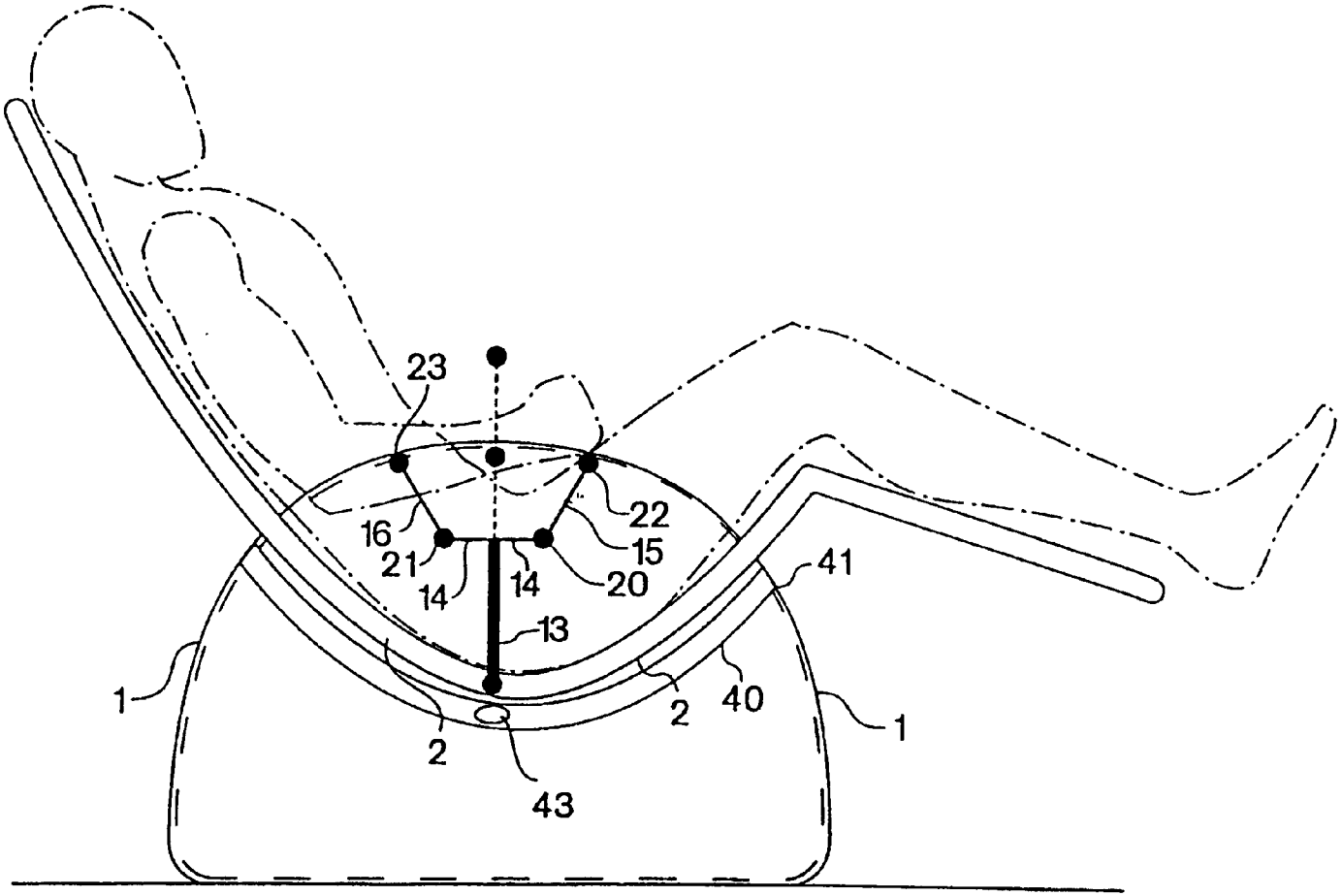
Figure 11:
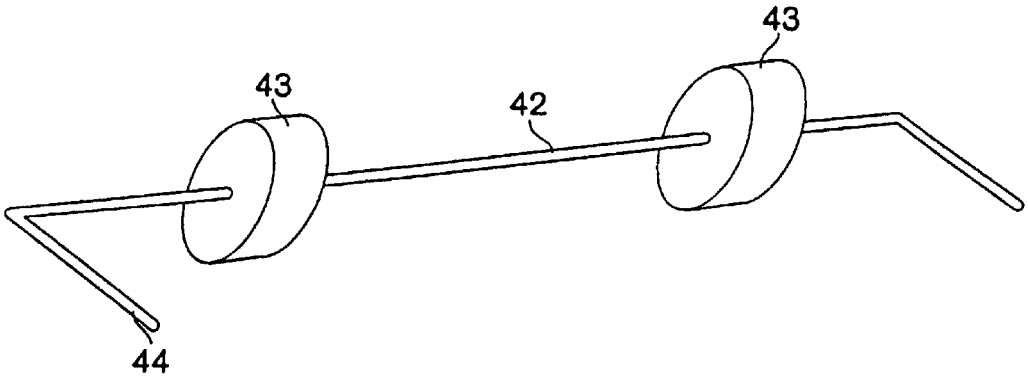

FIG. 6 diagrammatically shows the position of the linkage mechanism of the present invention when the armchair of FIG. 4 is in the fully upright position;

FIG. 7 diagrammatically shows the position of the linkage mechanism of the present invention when the armchair of FIG. 4 is in the intermediate position;

FIG. 8 diagrammatically shows the position of the linkage mechanism of the present invention when the armchair of FIG. 4 is in the fully reclined position;

FIG. 9 diagrammatically shows the linkage mechanism of FIG. 4 incorporating a locking member to hold the armchair in the upright position;

FIG. 10 is a view similar to FIG. 4 but showing another embodiment of a locking member;

FIG. 11 is a detail view of the locking mechanism shown in FIG. 10; and

Figure 12:
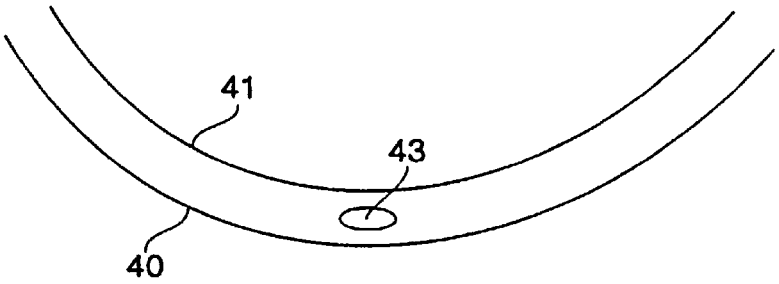
Figure 13:
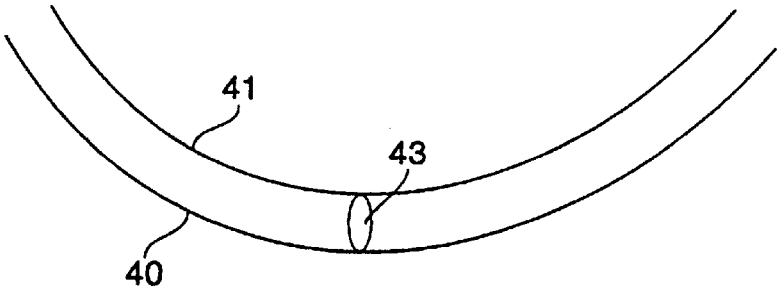

FIGS. 12 and 13 are diagrammatic views of a portion of the locking mechanism showing it in the unlocked and locked positions, respectively.

Figure 5:
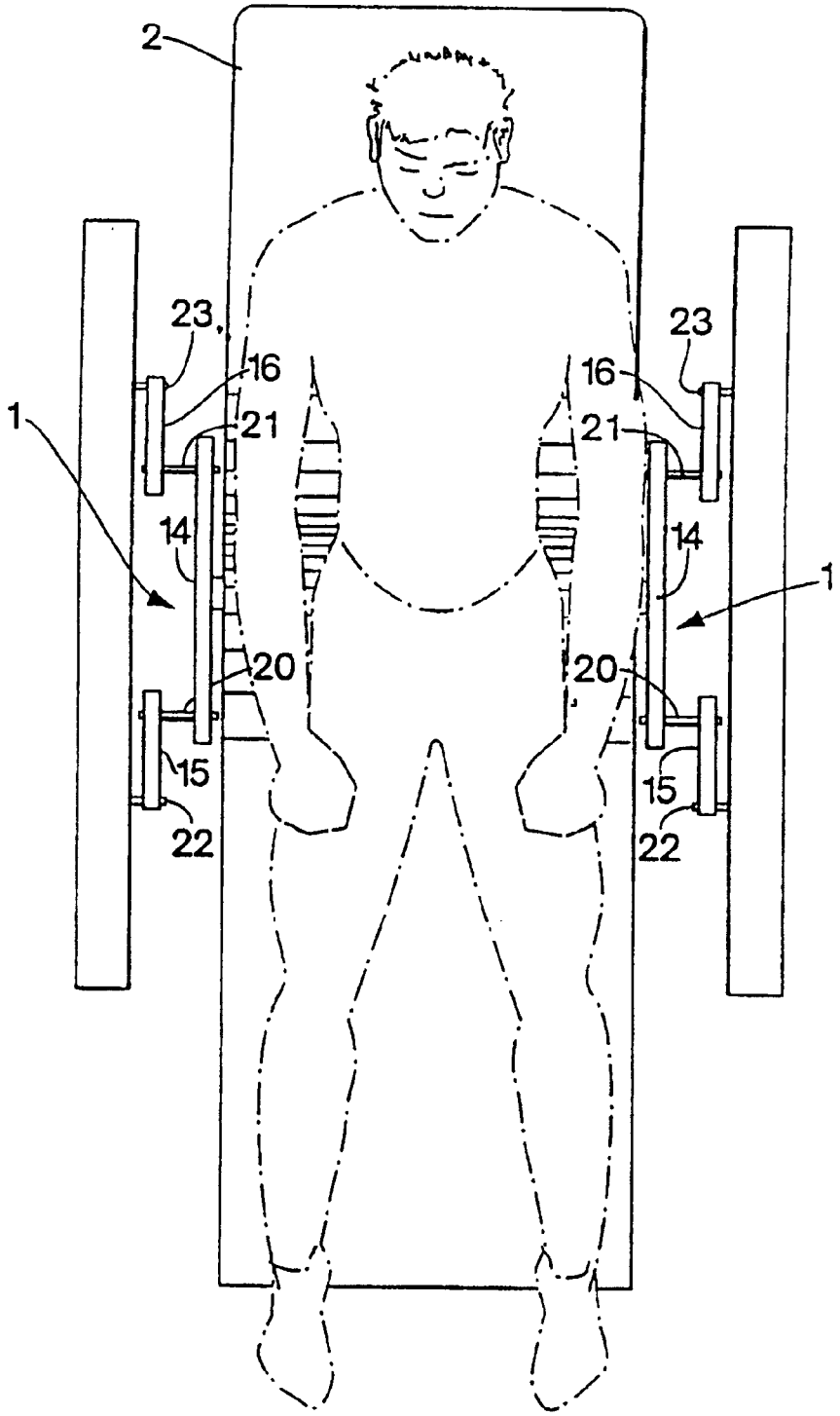
FIG. 5 is a top plan view of the armchair of FIG. 4.

As may be seen from FIG. 4, a reclinable armchair incorporating the present invention may comprise a base unit 1 and a reclinable unit 2 incorporating a backrest section, a seat section and a footrest section in fixed structural relationship to one another. As can be more clearly seen in FIG. 5, the base unit 1 incorporates two side members, the reclinable element being suspended between the side members by means of two linkage mechanisms according to the present invention.

The centre of gravity leveling effect provided by the present invention can be achieved by linkage arrangement of four rigid members (links) in which two downwardly converging swing links 15, 16 are pivoted from pivots 22 and 23, respectively, which are attached to the upper part of base structure 1, pivot 23 being behind pivot 22 in the feet-to-head direction. The other end of said links 15, 16 are pivotally connected to the ends of a further link or rigid 14 at pivots 20, 21. The pivot 20 and 21 are closer together than pivot 22 and 23. At a point between pivots 20 and 21 on link 14, a downwardly extending member 13 is rigidly attached. The lower end of member 13 is rigidly attached to the reclinable seating element 2. The links 14, 15 and 16 with the base 1 between the pivots 22 and 23 form a four-bar linkage. The link 14 is generally disposed below the level of the pivots 22 and 23.

Figure 1:
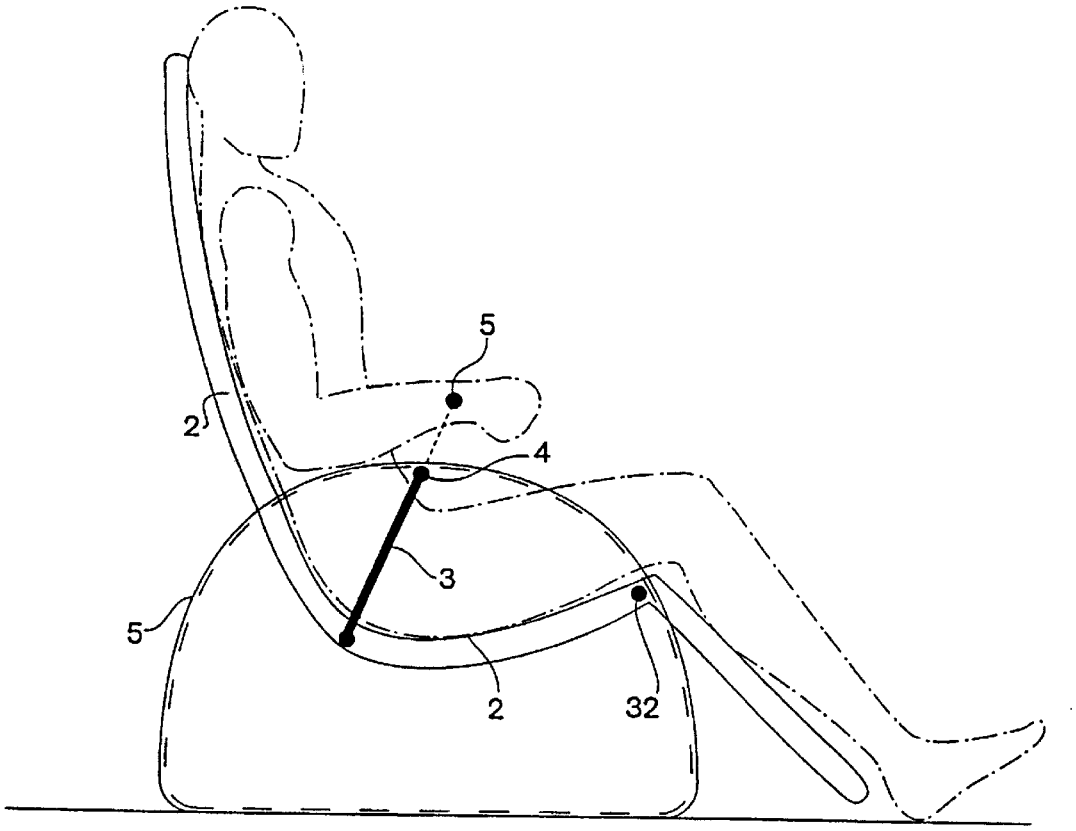
Fig. 1 (PRIOR ART)
Figure 2:
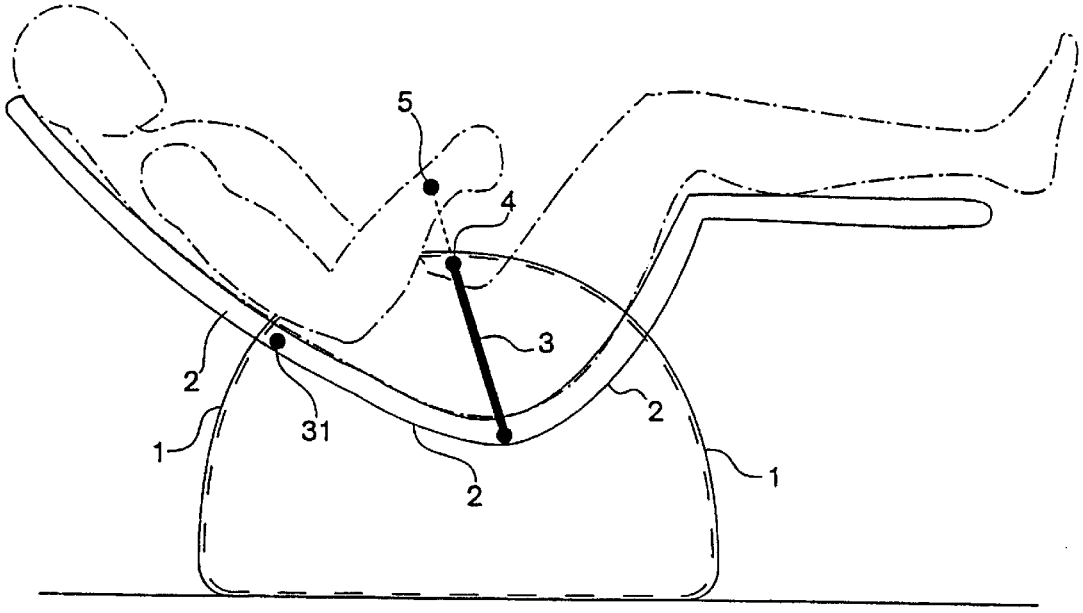
Fig. 2 (PRIOR ART)
Figure 3:
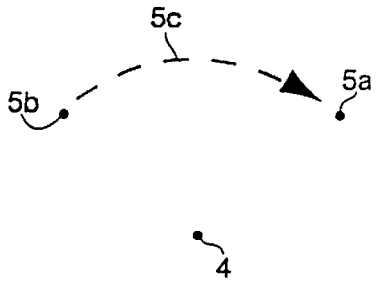

FIGS. 6, 7 and 8 show the position of the linkage mechanism members (links) 14–16 in the upright, partially reclined (intermediate) and fully reclined positions, respectively. The typical range of reclining movement is 30°–60°. As seen in these diagrams this arrangement leads to the movement of the centre of gravity 5 remaining approximately horizontal, as opposed to its movement as shown in FIG. 3 which shows the result of suspending the seating element 2 from a single fixed pivot axis 4, as in the armchair known from U.S. Pat. No. 4,790,599 and shown in FIGS. 1–3. This effect arises because the pivot axis is (inevitably) lower than the centre of gravity.

It will be realized that the present invention cannot totally guarantee an absolutely horizontal movement of the centre of gravity 5 for all users, mainly because of differences in body build. However, the small amount of friction inevitably present in the system covers small residual imbalances and also a user will be able to optimize the balance of the chair by altering the position of his body in the chair, e.g. moving a centimeter or so forwards or backwards. Furthermore, the small effort required on the user's part to rotate the reclinable element 2 between its various positions is not only acceptable but actually beneficial, as it allows the position to be changed only when desired.

An occupant can move the reclining armchair between positions by shifting his bodyweight e.g. by moving his arms, or by exerting a force on the base unit 1 e.g. by pushing or pulling on arms of the chair (not shown) which may be affixed thereto.

Although it is important for the lengths and relative proportions of the links 14–16 to be accurately reproduced in chairs of a given design incorporating the mechanism of the present invention, it is envisaged that variations in their lengths and relative proportions will be required for different seating element 2 designs and different designs of base unit 1.

It is often desired to lock reclining chairs in the upright position. One way in which this may be achieved in chairs incorporating the mechanism of the present invention is shown in FIG. 9, where a rigid arm 34 is pivotally connected to the base 1 at 35. In the locked state, the arm 34 is rotated over pivot 35 so as to rest against a point 33 (preferably an outwardly projecting element) on member 13. To unlock the chair, arm 35 is lifted clear (34*a*) of projecting element 34.

Another possible locking method involves the use of one or more oval or other non-circular cross-section members 43 affixed to and movable with the reclinable unit 2 and running in a guide trough or between guide rails 40, 41 (FIG. 10). Rotation of the members 43 within the trough or between the rails e.g. by means of handle 44 (FIG. 11) moves the member(s) from a position in which the chair is free to move (FIG. 12) and a locking position (FIG. 13). In the locking position, the short axis of the oval 43 lies in the direction of the rails 40, 41, in the unlocked state the long axis of the oval 43 lies in the direction of the rails 40, 41. This mechanism allows the chair to be locked in any position and only ¼ turn of handle 44 is required to lock and release the chair.

Optional provisions of various known types can be included for arresting the seating element. Also or alternatively, additional friction can be introduced into the pivots or by way of the upholstery.

The supporting member and links 13–16 of the linkage mechanism may be formed from any suitable material, but they must be strong enough to bear the weight of the reclinable element 2 and an occupant. Steel is a possible manufacturing material.

I claim:

1. A reclining chair comprising:

a frame having a top;

a reclining unit having a back, seat and footrest; and a mechanism on each side of the reclining unit for mounting the reclining unit on the frame, said each of said mechanisms including a pair of swing links pivotally connected at the top of the frame at a first pair of spaced apart pivot points and interconnected through a rigid member at a second pair of pivot points closer together than the first pair of pivot points, said rigid member being disposed generally below the first pair of pivot points, said reclining unit being rigidly connected to the rigid member preventing relative movement between the reclining unit and the rigid member as the reclining unit moves between upright and reclined positions.

2. A reclining chair as defined in claim 1 wherein said rigid member is a third link, a second rigid member is rigidly connected to the mid-portion of the third link and extends downwardly therefrom; and the reclining unit is rigidly connected to the second rigid member below the connection of the second rigid member to the third link.

3. A reclining chair as defined in claim 2 wherein the footrest, seat and back of the reclining unit are in fixed position with respect to one another.

4. A reclining chair as defined in claim 1 wherein the footrest, seat and back of the reclining unit are in fixed position with respect to one another.

* * * * *